United States Patent [19]

Bürger

[11] 4,442,731

[45] Apr. 17, 1984

[54] CRANK DRIVE FOR SOIL COMPACTING APPARATUS

[75] Inventor: Hans Bürger, Esslingen, Fed. Rep. of Germany

[73] Assignee: Delmag-Maschinenfabrik Reinhold Dornfeld GmbH & Co., Esslingen, Fed. Rep. of Germany

[21] Appl. No.: 281,224

[22] Filed: Jul. 6, 1981

[30] Foreign Application Priority Data

Jul. 7, 1980 [DE] Fed. Rep. of Germany ..... 3025667
May 27, 1981 [DE] Fed. Rep. of Germany ..... 3121007

[51] Int. Cl.[3] ..... G05G 1/00

[52] U.S. Cl. ..... 74/571 R; 74/571 L; 74/600

[58] Field of Search ..... 74/117, 122, 571 R, 74/571 M, 600, 835, 837, 123, 571 L

[56] References Cited

U.S. PATENT DOCUMENTS 2,477,587 8/1949 Doutt ..... 74/571 R X
2,834,223 5/1958 Strnad ..... 74/571 R X
3,008,347 11/1961 Perkins et al. ..... 74/600 X
3,426,616 2/1969 Van der Winden ..... 74/571 R
4,294,136 10/1981 Greppmair et al. ..... 74/600

*Primary Examiner*—Lawrence J. Staab
*Assistant Examiner*—Frank McKenzie
*Attorney, Agent, or Firm*—Shenier & O'Connor

[57] ABSTRACT

A crank device for soil compacting apparatus having a crank shaft and a connecting rod coupled to each other by two eccentric elements rotatable about parallel shafts in which the first eccentric element is provided with a plurality of recesses and the second element is provided with a locking bolt with the elements being rotatable to relative positions at which recesses respectively are generally aligned with said bolt, with the bolt being mounted for movement between a first position at which it can enter a first recess generally aligned therewith and cannot enter a second recess generally aligned therewith and a second position at which it cannot enter the first recess aligned therewith and can enter the second recess aligned therewith.

14 Claims, 9 Drawing Figures

CRANK DRIVE FOR SOIL COMPACTING APPARATUS

DESCRIPTION

The invention relates to a crank drive device for soil compacting apparatus, with a crankshaft and a connecting rod coupled to each other by means of two axially parallel eccentric elements, which are rotatable and lockable relative to each other for the purpose of altering the total eccentricity. Such devices are intended to alter the length of the connecting rod stroke.

In known constructions of this kind adjusting the length of stroke is either difficult or involves substantial costs of construction. It was therefore the object of the invention to provide a crank drive device of the kind initially mentioned, in which the length of stroke can be rapidly and simply changed and set without calling for expensive devices. According to the invention, this problem is solved in that the first eccentric element is provided with a plurality of recesses and the second eccentric element is provided with a locking bolt which can be optionally inserted into one of the recesses to fix and change the angular position of the eccentric elements relative to each other and that the said locking bolt is so constructed and can be so placed in the eccentric element associated therewith and that the recesses are so constructed and arranged that the locking bolt can be inserted into a recess of the second eccentric element only in a specific position relative to its eccentric element and only in a predefined angular position of the two eccentric elements relative to each other which said angular position is associated with the locking bolt. The position of the locking bolt therefore defines the total eccentricity and therefore the length of stroke (flow) of the crankdrive in that the position and shape of the locking bolt in the recesses are so selected and adapted to each other that, given a specific position of the locking bolt, this fits into only one of the recesses if the first eccentric element has a specific angular position relative to the second eccentric element.

In referring to the resetting of the locking bolts, this also includes an exchange of locking bolts whose shape differs from each other. This definition is also intended to apply to constructions in which a locking bolt can be inserted at different places of the eccentric element associated therewith and applies to constructions in which the locking bolt is always located at the same position of the eccentric element associated therewith but is reset but rotation about its longitudinal axis or reversal relative to its eccentric element. Finally, the definition of resetting is to include removal, turning, reinsertion of the locking bolt from or into its eccentric element as well as rotation of the locking bolt, for as long as this is disposed within its eccentric element.

In the preferred embodiment of the crank drive device according to the invention, the first eccentric element is rotatably supported in an eccentric bearing (for example journal or bore) of the second eceentric element; it is however also feasible to support the eccentric element upon each by means of one or more intermediate components.

In one modification of the preferred embodiment of the construction according to the invention the locking bolt can be reset about its longitudinal axia and its region, which can be inserted into the recesses, has a cross-section which is non-rotationally symmetrical with respect to the longitudinal axis of the bolt. The engagement region of a locking bolt can therefore have a rotationally symmetrical cross-section but this is offset with respect to the longitudinal axis of the locking bolt; it is also possible to provide this engagement region with a cross-section, for example an oval or polygonal cross-section which can then also be arranged concentrically with respect to the longitudinal axis of the bolt.

To facilitate the insertion of a locking bolt into one of the recesses it is recommended to construct the engagement region of the locking bolt and/or of the recesses so that they have a diminishing taper in the direction of the longitudinal axis of the bolt. This is particularly advantageous if a crank drive device is required in which the total eccentricity and therefore the length of stroke (throw) of the crank drive can be preselected and the locking bolt drops into the appropriate recess only when the crank drive starts.

An alternative to a construction with differently shaped recess provides for recesses with different distances from the relative axis of rotation of the two eccentric elements; such a construction can be produced particularly economically, especially if the locking bolt is rotatable relative to its eccentric element for the purpose of being reset and has an eccentric engagement region with respect to its axis of rotation so that the said engagement region can also be provided with a circular cross-section.

To ensure even more rapid dropping of the locking bolt into the recess of the first eccentric element associated with the preselected position of said locking bolt, a preferred embodiment of the eccentric element is provided with an insertion indentation for the locking bolt in front of each recess as seen in the rotating direction of the locking bolt. This indentation can take the shape of a slope inclined in the direction towards the recess but it can also be constructed as a slot whose width, as measured in the radial direction of the eccentric element, corresponds to the diameter of the engagement region of the locking bolt, measured in the same direction, namely when the said locking bolt assumes a preselected position in which it will then drop into the recess mentioned above. In such an embodiment it is advisable for the region of the insertion indentation adjacent to the recess to be made less deep than the recess so that the locking bolt, which has dropped into the said recess, interconnects the two eccentric elements, which are to be coupled to each other, so that they are free of slack in both directions of rotation. These insertion indentations also permit the engagement region of the locking bolt and the recesses to be constructed in circular cylindrical form so that they can not only be produced more simply but the locking bolt also provides a bearing action against the walls of the recesses which is an improvement compared with a conical design.

Further features, advantages and details of the invention are disclosed in the attached claims and/or the description hereinbelow and the attached illustrations of three particularly advantageous embodiments of the crank drive device according to the invention which are used in a vibratory tamping device; in the drawing:

Figure 1:
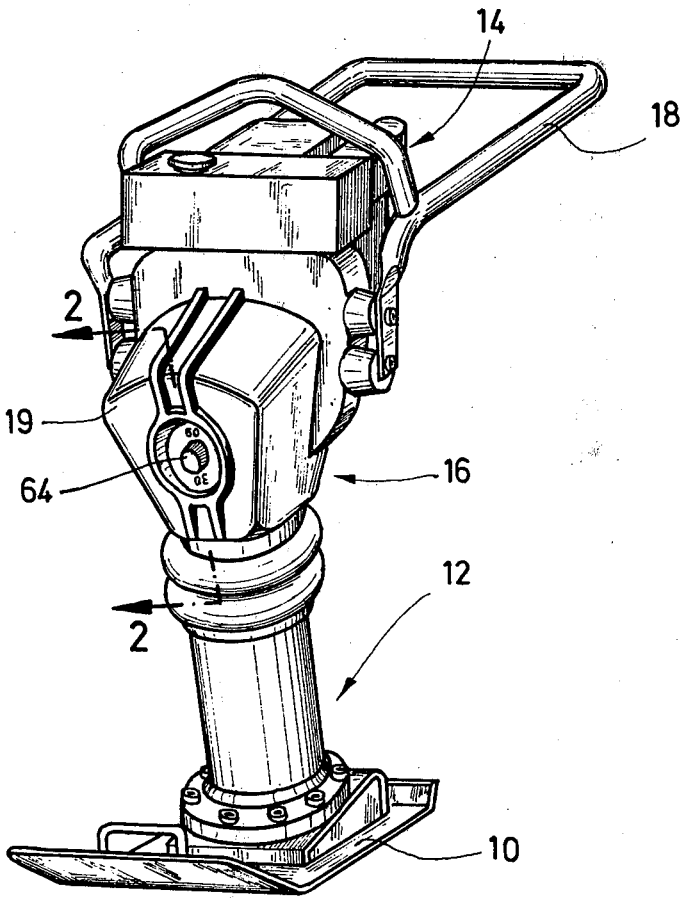
FIG. 1 is a perspective view of such a vibratory tamping device.

The vibratory tamper, shown in FIG. 1, characterised by a crank drive with the length of stroke adjustment according to the invention, bears on a tamping plate 10 which is connected via a so-called clamping base 12 to a driving unit substantially comprising an internal combustion engine 14 and a transmission 16. A guide handle 18 is provided to guide the vibratory tamper. The transmission 16 comprises a crank drive by means of which the rotating motion of the drive shaft of the internal combustion engine 14 is converted into a vertical reciprocating motion of the tamping plate 10.

The transmission 16 will now be explained by reference to FIG. 2.

A drive shaft 20, having a pinion 22 formed thereon, is rotatably supported in an apparatus casing 19. The said pinion is in mesh with a gear rim 24 of a crankshaft 26 which is also rotatably supported in the casing 19 by means of rolling bearings 28 and 30 and is provided with a crank pin 34 which is eccentric with respect to the axis of rotation of the crankshaft. With the interposition of a plain bearing 36 the crank pin rotatably supports an eccentric bush 38, whose cylindrical circumferential surface 40 forms a second eccentric with respect to the axis of the crank pin, which represents the first eccentric.

With the aid of a needle bearing 44, the eccentric bush 38 rotatably supports a connecting rod 46, which drives, via a bearing pin 48, a shaft 52 which is slideably guided by a guideway 50 of the tamping base 12 and is mounted on the vibratory plate and thus imparts a vertical reciprocating motion to the said shaft.

According to the invention a bore 60, more particularly a stepped bore, which is parallel with the axis of rotation, is provided in the crankshaft 26, eccentrically with respect to its axis of rotation and a locking bolt 62 is rotatably and slideably guided in the said bore. The locking bolt is provided with a handle 64 and a head 66, guided by an expanded part of the bore 60 and having a cone 70 which is eccentric with respect to the bore 60 and is adapted to engage in likewise conical apertures 72 of a disc 74 which is integrally formed on the eccentric bush 38. According to the invention both the cone as well as the apertures 72 have circular cross-sections in this embodiment.

Between the shoulder of the stepped bore 60 and the head 66 of the locking bolt 62 there is disposed an engagement spring 78 which tends to thrust the cone 70 of the locking bolt into one of the apertures 72 of the eccentric bush 38. The particular aperture 72 into which the cone 70 is able to drop depends on the angular position of rotation of the locking bolt 62 relative to the crankshaft as will be explained subsequently. According to the invention, a locking pin 90, mounted in the crankshaft 26 and apertures 92 in the handle of the locking bolt 62 are provided to define a specific position for the locking bolt 62 and the number of apertures 92 and therefore the number of positions of the locking bolt 62 corresponds to the number of apertures 72, which differ in some respect and are situated in the eccentric bush 38, in accordance with the invention. The locking bolt 62 can therefore be lifted to the left out of the disc 74 and out of the locking pin 90 against the action of the engagement spring 78 according to FIG. 2, can then be rotated with respect to the crankshaft 26 and can then again be released so that the locking pin 90 once again engages with one of the apertures 92 and as a result of a relative rotation between the crankshaft 26 and the eccentric bush 38, the eccentric cone 70 of the locking bolt 62 is able to engage in one of the other apertures 72 of the eccentric bush 38 (preselector operation).

Figure 5:
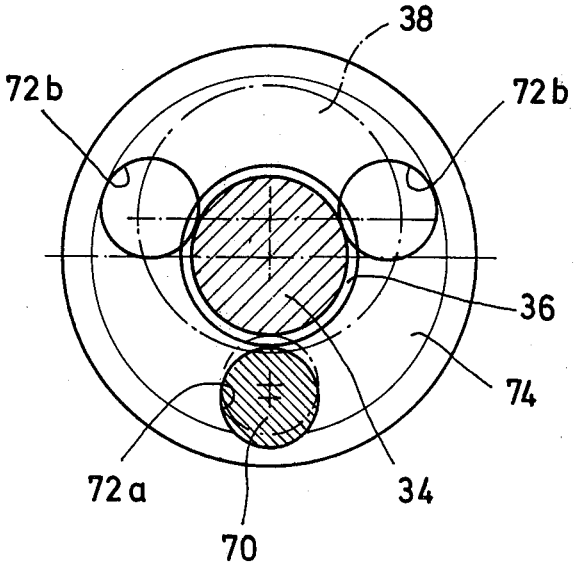
FIG. 5 is a section along the line 5—5 of FIG. 2.

As can be seen by reference to FIG. 5, the eccentric bush 38 is provided with three apertures in the illustrated embodiment of the disc 74, namely an aperture 72*a* and two apertures 72*b*, which are symmetrical with respect to the former but are situated closer to the crank pin 34. The eccentricity of the cone 70 of the locking bolt 62 and the position of the apertures 92 in the handle 64 of said locking bolt, the handle 64 having two such apertures 92, is such that in one position of the locking bolt in which the locking pin 90 engages with one of the apertures 92, the cone 70 of the locking bolt is able to drop in and fittingly engage only with the aperture 72*a* and in the second possible position of the locking bolt 62 is able to drop and fittingly engage with each of the apertures 72*b*. According to the invention it is therefore possible to preselect and define two different angular positions of rotation of the eccentric bush 38 relative to the crankshaft 26 and the aperture 72*a* and 72*b* are arranged so that when the locking bolt 62 has dropped into the aperture 72*a* the eccentricities of the crank pin 34 and the eccentric 40 are additive (the situation illustrated in FIG. 2) while with the locking bolt 62 engaging in one of the apertures 72*b* the eccentricity of the crank pin 34 is reduced by part of the eccentricity of the eccentric 40, in one case resulting in a longer and in the other case in a shorter stroke of the shaft 52 and therefore of the vibratory plate 10.

According to the invention, a centrifugal clutch 100 is disposed between the internal combustion engine 14 and the drive shaft 20, so that the crankshaft 26 is entrained at relatively low rotational speeds of the internal combustion engine 14.

Figure 2:
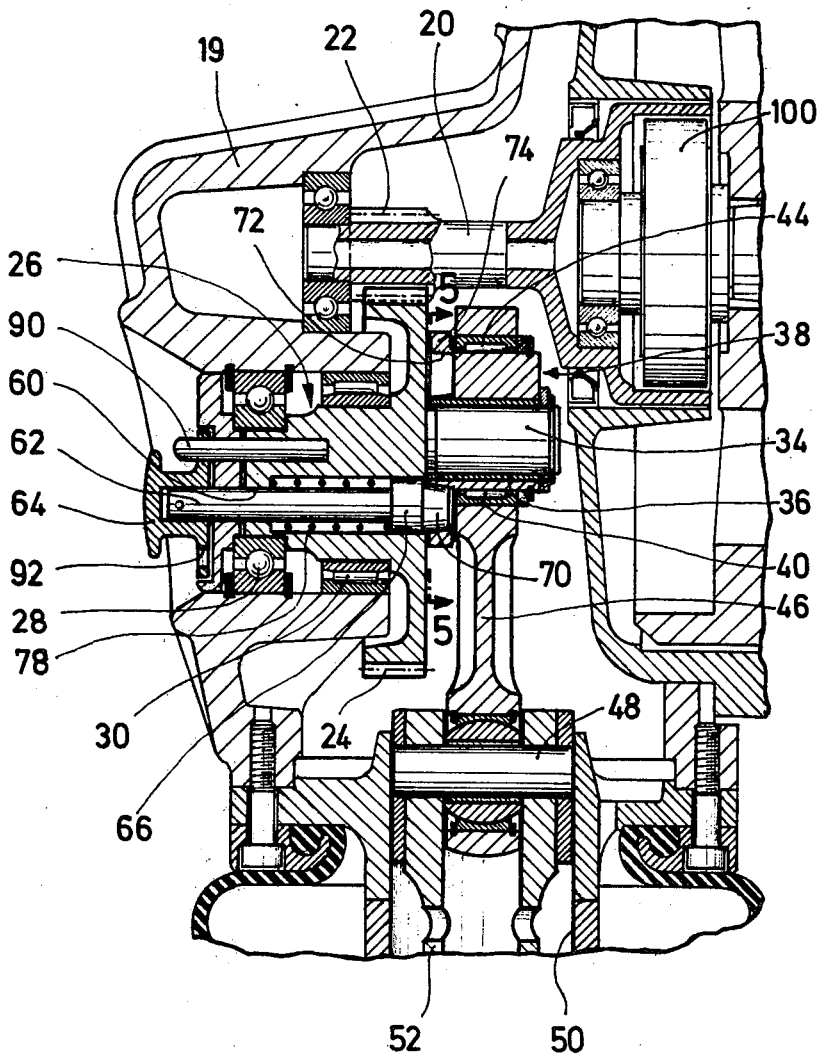
FIG. 2 is a section through the transmission of the said vibratory tamping device along the line 2—2 of FIG. 1.
Figure 3:
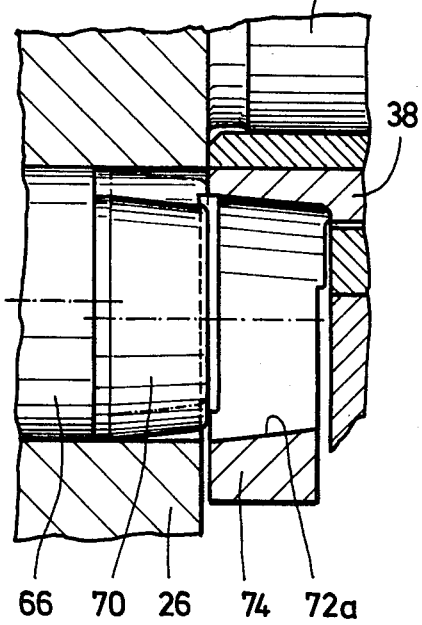
FIG. 3 shows a larger view of the engagement region of the locking bolt and of the surrounding parts with the locking bolt retracted.
Figure 4:
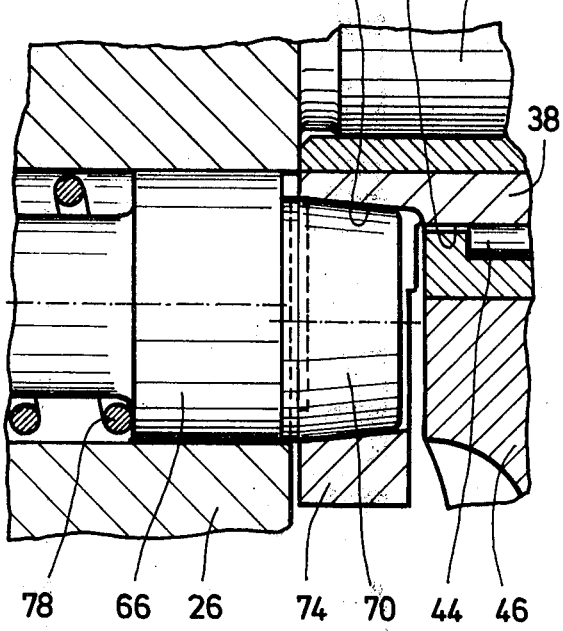
FIG. 4 is a view corresponding to FIG. 3 but with the locking bolt operative.

If the locking bolt 62 according to FIG. 2 is drawn to the left, the deadweight of the apparatus will thrust the eccentric bush 38 into its top dead-centre position in which, according to the invention, the aperture 72*a* will be situated opposite to the locking bolt. If the locking bolt is then rotated into a position in which it is not able to drop into the aperture 72*a* but only into one of the apertures 72*b*, the angle of rotation with respect to each of the apertures 72*b* is of equal magnitude, according to the invention, when the apparatus starts, so that the process of engagement of the locking bolt 62 is independent of the direction of rotation of the internal combustion engine.

Figure 7:
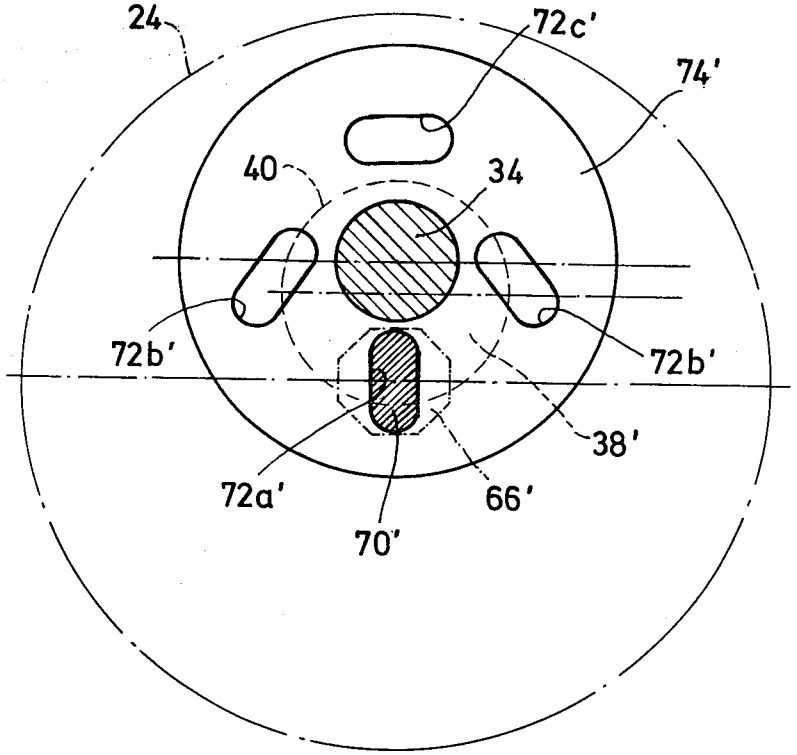
FIG. 7 is a section along the line 7—7 of FIG. 6.
Figure 6:
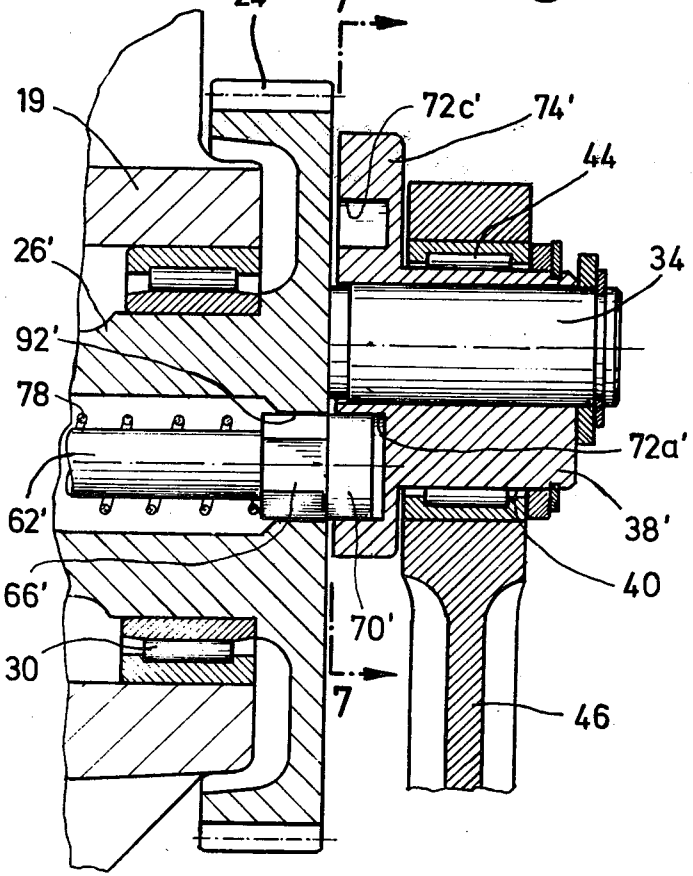
FIG. 6 is a view of a modification in sectional form similar to that of FIG. 2.

Although the embodiment according to FIGS. 2 to 5 provides two adjustable lengths of stroke, which can be correspondingly marked on the handle 64, as can be seen in FIG. 1, the modified embodiment according to FIGS. 6 and 7 permits three different strokes to be set. However, since the two embodiments are very similar to each other, only the differences between them will be explained hereinbelow.

In the embodiment according to FIGS. 6 and 7 the locking bolt 62' is provided with an octagon head 66' which can fittingly engage in an octagon aperture 92' of the crankshaft 26'. The place of the eccentric cone 70 of the first embodiment is taken by a cone 70' which is concentric with the longitudinal centre axis of the locking bolt 62 and has an oval cross-section and is associated with four apertures 72a', 72b' and 72c' in the disc 74' of an eccentric bush 38'. The apertures 72b' are situated in mirror image configuration with respect to the aperture 72a' while the aperture 72c' is added as the fourth aperture. As can be readily seen by reference to FIG. 6 and 7, the aperture 72' is associated with the longest length of stroke and the aperture 72c' with the shortest length of stroke, while each of the apertures 72b' corresponds to a stroke of medium length.

According to the invention, the aperture 72a', 72b' and 72c' are arranged so that in each of the possible positions of the locking bolt 62, the oval cone 70' thereof is able to drop into only a particular aperture of the apertures 72a'-72c', so that each angular position of rotation of the locking bolt corresponds to a specific length of stroke.

Figure 8:
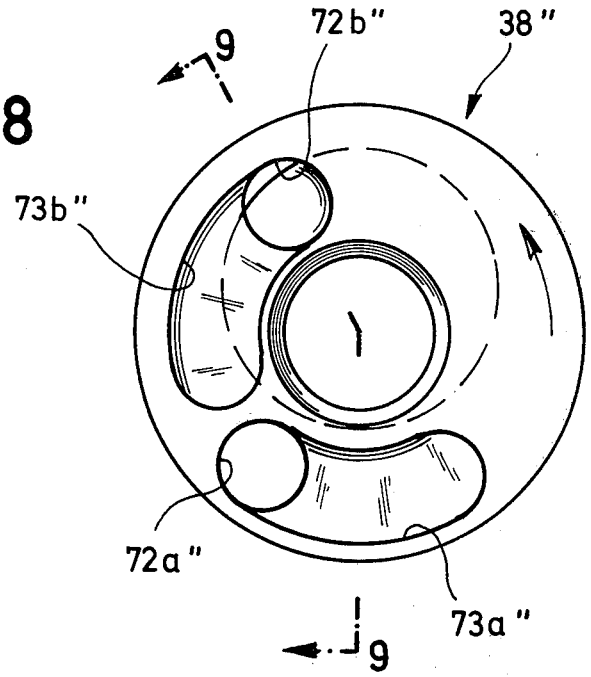
FIG. 8 is a view corresponding to FIGS. 5 and 6 of a third embodiment of an eccentric bush and FIG. 9 is a section along the line 9—9 of FIG. 8 but with the unsectioned front region of the associated locking bolt.
Figure 9:
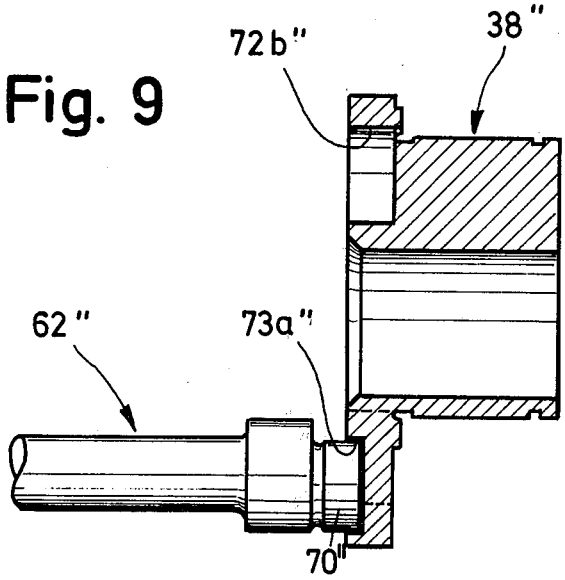

In the third embodiment according to FIGS. 8 and 9 steps have been taken which result in even more rapid dropping of the locking bolt into recesses associated with the preselected position of the locking bolt.

To this end-and as seen in the operating direction of the locking bolt 62"—an insertion indentation 73a" or 73b" is situated in front of each aperture 72a", 72b" and is constructed in the preferred embodiment as a circular arcuate slot. The slot width measured in the radial direction corresponds to the diameter of a circular cylindrical eccentric 70" of the locking bolt 62". To interconnect the two eccentric elements—the crankshaft 26 or 26' and the eccentric bush 38"—without slack in both directions of rotation, the insertion indentations 73a" and 73b" are provided in accordance with the invention with a lower depth than the depth with which the locking bolts 62" engage with the apertures 72a" and 72b".

The direction of rotation of the eccentric bush 38" in relation to the locking bolt which has not yet dropped in, is marked with an arrow in FIG. 8. Since releasing of the locking causes the deadweight of the machine to rotate the eccentric bush 38" into the position in which the crank pin 34 is situated at its top dead centre—this position of the eccentric bush 38" is shown in FIG. 2—one group comprising an aperture and associated insertion indentation is so arranged that the locking bolt is able to drop into an aperture immediately or shortly after the centrifugal clutch 100 engages. In the illustrated third exemplified embodiment the aperture 72a" and the insertion indentation 73a" are situated at the bottom in the eccentric bush 38". The other groups (in this case 72b", 73b") are arranged in the direction of rotation as close as possible to the first group (in this case 72a", 73a").

The invention therefore provides a crank drive in which a specific length of stroke or change of length of stroke can be set up practically without effort since it is merely necessary to draw the locking bolt. The desired length of stroke can thus be preadjusted and it is a special feature of the invention that slow starting of the vibratory tamper causes the two eccentrics to be automatically locked relative to each other, namely in an angular rotary position which corresponds to the preselected position of the locking bolt.

Some other suitable securing element can of course also take the place of a locking bolt.

Having thus described my invention, what I claim is:

1. A crank device for soil compacting apparatus having a crankshaft and a connecting rod and a pair of eccentric elements rotatable about parallel axes for coupling said connecting rod to said crankshaft, said eccentric elements being lockable relative to each other to set the overall eccentricity provided by said elements, characterized in that a first eccentric element is provided with a plurality of recesses and the second element is provided with a locking bolt, said elements being rotatable to relative positions at which said recesses respectively are generally aligned with said bolt, and means mounting said bolt on said second element for movement between a first position at which it can enter a first recess generally aligned therewith and cannot enter a second recess and a second position at which it cannot enter said first recess and can enter said second recess generally aligned therewith.

2. Apparatus according to claim 1, characterised in that the first eccentric element (38) is rotatably supported in an eccentric bearing (34, 36) of the second eccentric element (26).

3. Apparatus according to claim 1, characterised in that the locking bolt (62) can be reset about its longitudinal axis and the portion thereof (70), which can enter into the recesses (72 ), has a cross-section which is not-rotationally symmetrical with respect to the longitudinal axis of the bolt.

4. Apparatus according to claim 1, characterised in that the locking bolt (62) and the recesses (72) have a diminishing taper in the direction of the longitudinal axis of the bolt.

5. Apparatus according to claim 1, characterised in that the recesses (72a, 72b) are located at different distances from the relative axis of rotation (axis of the crankpin 34) of the two eccentric elements (26, 38).

6. Apparatus according to claim 1, characterised in that the locking bolt (62) is rotatable relative to its eccentric element (26) for the purpose of being reset and has a recess entering portion (70) which is eccentric with respect to its axis of rotation.

7. Apparatus according to claim 1, characterised in that the recess entering portion (70') of the locking bolt (62') has a cross-section which deviates from the circular shape.

8. Apparatus according to claim 1, characterised in that the recesses (72) have a cross-section, the shape and size of which is adapted to the cross-section of the recess entering portion (70) of the locking bolt (62), so that the said recesses accommodate the locking bolt without clearance.

9. Apparatus according to claim 8 characterised in that the recess entering portion (70") of the locking bolt (62") is of circular cylindrical shape.

10. Apparatus according to claim 1 characterised in that one eccentric element (26) has a bore (60) into which the locking bolt (62) can be inserted in different positions and in which it is retained against rotation in the inserted position.

11. Apparatus according to claim 1 characterised by a spring (78), adapted to thrust the locking bolt (62) into a recess.

12. Apparatus according to claim 1 characterised in that the recesses (72a', 72b', 72c') have different orientations with respect to the relative axis of rotation of the two eccentric elements (26', 38').

13. Apparatus according to claim 1 characterised in that the eccentric elements (38'') which is provided with recesses (**72*a''*, 72*b''*) is provided with an insertion indentation (73*a''*, 73*b''*) for the locking bolt in front of each recess as seen in the direction of rotation of the locking bolt (62''**).

14. Apparatus according to claim 13, characterised in that the recesses (for example **72*a''***) the deeper than the adjacent region of the insertion indentation (for example 73*a''*) and the latter merges via a step with the recess so that the step forms a stop abutment for the engagement region (70'') of the locking bolt (62'') which has dropped into the recess.

* * * * *

UNITED STATES PATENT AND TRADEMARK OFFICE

CERTIFICATE OF CORRECTION

PATENT NO. : 4,442,731

DATED : April 17, 1984

INVENTOR(S) : Hans Bürger

It is certified that error appears in the above-identified patent and that said Letters Patent are hereby corrected as shown below:

Column 8, line 1, "the" (second occurrence) should read -- are --.

Signed and Sealed this

Fourth Day of September 1984

[SEAL]

*Attest:*

GERALD J. MOSSINGHOFF

*Attesting Officer*

*Commissioner of Patents and Trademarks*